US008989623B2

(12) United States Patent
Koishi et al.

(10) Patent No.: US 8,989,623 B2
(45) Date of Patent: Mar. 24, 2015

(54) IMAGE FORMING APPARATUS AND CARTRIDGE

(71) Applicant: Canon Kabushiki Kaisha, Tokyo (JP)

(72) Inventors: Isao Koishi, Yokohama (JP); Masanari Morioka, Yokohama (JP); Tetsuya Numata, Suntou-gun (JP); Hiroyuki Munetsugu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 113 days.

(21) Appl. No.: 13/898,175

(22) Filed: May 20, 2013

(65) Prior Publication Data

US 2013/0315618 A1 Nov. 28, 2013

(30) Foreign Application Priority Data

May 22, 2012 (JP) ..... 2012-116937

(51) Int. Cl.
*G03G 15/00* (2006.01)
*G03G 21/18* (2006.01)

(52) U.S. Cl.
CPC .... *G03G 21/1842* (2013.01); *G03G 2221/1684* (2013.01)
USPC ..... 399/110; 399/112

(58) Field of Classification Search
USPC ..... 399/110–113
See application file for complete search history.

(56) References Cited

U.S. PATENT DOCUMENTS

2001/0028811 A1* 10/2001 Kojima et al. ..... 399/111

FOREIGN PATENT DOCUMENTS

JP 2007-164094 A 6/2007
JP 2007-213024 A 8/2007

* cited by examiner

*Primary Examiner* — David Bolduc
*Assistant Examiner* — Barnabas Fekete
(74) *Attorney, Agent, or Firm* — Canon U.S.A., Inc. IP Division

(57) ABSTRACT

An image forming apparatus includes a plurality of cartridges, and a moving member to which the plurality of cartridges is detachably attached. Of a pair of cartridges attached to the moving member and adjacent to each other, one cartridge has a recessed portion recessed from a frame member thereof and extending in an attachment direction of the cartridge, and the other cartridge has a raised portion protruding from the frame member thereof and extending in the attachment direction. The raised portion provided on the other cartridge enters the recessed portion provided in the one cartridge when the pair of cartridges is attached to the moving member. Positions of the raised portion and the recessed portion overlap each other as viewed in an axial direction of the image bearing member.

16 Claims, 9 Drawing Sheets

IMAGE FORMING APPARATUS AND CARTRIDGE

BACKGROUND OF THE INVENTION

1. Field of the Invention

The present invention relates to an image forming apparatus such as a copying machine or a printer, and to a cartridge that can be attached to an apparatus main body of such an image forming apparatus.

2. Description of the Related Art

Examples of the image forming apparatus include an electrophotographic image forming apparatus configured to form an image on a recording medium by using, for example, electrophotography. Examples of the electrophotographic image forming apparatus include an electrophotographic copying machine, an electrophotographic printer (e.g., a laser beam printer or a light-emitting diode (LED) printer), a facsimile apparatus, and a word processor.

In an electrophotographic image forming apparatus using electrophotography, such as a printer, an electrophotographic photosensitive member serving as an image bearing member (hereinafter referred to as a photosensitive drum) is uniformly charged, and a latent image is formed through selective exposure of the photosensitive drum. The latent image is developed with developer (hereinafter referred to as toner), and is made visible as a toner image. Then, the toner image is transferred to the recording medium.

By applying heat and pressure to the transferred toner image, the toner image is fixed to the recording medium, thus recording the image. Conventionally, such an image forming apparatus has involved maintenance of various process units.

As a means for facilitating this maintenance, there is adopted a cartridge system in which a photosensitive drum, a charging unit, a developing unit, a cleaning unit, etc., are all or partially integrated into a cartridge. In this system, the cartridge is attachable and detachable to and from an electrophotographic image forming apparatus.

In this cartridge system, it is possible for the user to perform maintenance on the apparatus by replacing the cartridge, so that it is possible to achieve a substantial improvement in terms of operability. Thus, this cartridge system is widely used in image forming apparatuses.

An image forming apparatus configured to form a color image, for example, is equipped with a plurality of cartridges. As a means for attaching and detaching the plurality of cartridges to and from the apparatus main body of the image forming apparatus, there is available a method which employs a moving member movable with respect to the apparatus main body, that is, a cartridge tray. The cartridge tray can move between the exterior and the interior of the apparatus main body with a plurality of cartridges placed thereon. By moving the cartridge tray to the interior of the apparatus main body with the cartridges placed on the cartridge tray, it is possible to attach the cartridges to the apparatus main body (Japanese Patent Application Laid-Open No. 2007-213024).

An example of the cartridge is formed by a cleaning frame member retaining a photosensitive drum, a charging unit, and a cleaning unit, a developing frame member retaining a developing unit, etc. The cleaning frame member has a waste toner accommodating portion configured to recover any toner adhering to the photosensitive drum without being used for image formation and to retain this waste toner. The developing frame member has a developer accommodating portion configured to accommodate toner to be carried by a developing unit (developing roller).

When, at the time of replacement of a cartridge, the user strongly grasps the cleaning frame member and the developing frame member constituting the cartridge, the inner pressure of the waste toner accommodating portion and of the developer accommodating portion increases, so that there is a fear of toner being scattered from within the cartridge.

Further, in the cartridge, in order to stabilize the quality of each process unit and to achieve an improvement in terms of their performance, it is necessary to perform high precision positioning on the components of each process unit and to maintain the positional relationship thus established until the end of their service life.

For the above reason, it is desirable that the cleaning frame member and the developing frame member exhibit high rigidity so that they may not undergo deformation.

Japanese Patent Application Laid-Open No. 2007-164094 proposes a cartridge whose frame members are provided with raised and recessed portions in order to mitigate the stress acting on the frame members due to temperature change during the transportation, storage, and use of the cartridge, thereby suppressing deformation of the frame members.

Generally, by providing the frame members of a cartridge with raised and recessed shapes, it is possible to enhance the rigidity thereof. However, when, as in the case of Japanese Patent Application Laid-Open No. 2007-164094, an attempt is made to arrange a plurality of cartridges in the apparatus main body of the image forming apparatus, there is the possibility of the raised and recessed shapes provided on the cartridges being allowed to interfere with each other. It might be possible to avoid this by enlarging the space provided inside the apparatus main body as the cartridge attachment portion and spacing the adjacent raised and recessed portions away from each other so that they may not interfere with each other. However, this would result in an increase in size of the image forming apparatus.

In particular, when a plurality of cartridges is attached to the apparatus main body of the image forming apparatus while placed on a cartridge tray (moving member), the size of the cartridge tray must also be increased. In this case, a large force and space may be required in order to move the cartridge tray.

SUMMARY OF THE INVENTION

The present invention is directed to an image forming apparatus in which an improvement is achieved in terms of the rigidity of a cartridge by providing the cartridge with raised and recessed portions. Further, the present invention is directed to an image forming apparatus equipped with a moving member configured to move with a plurality of cartridges attached thereto, wherein it is possible to achieve a reduction in size of the moving member and of the apparatus main body of the image forming apparatus while enhancing the rigidity of the cartridge.

According to an aspect of the present invention, an image forming apparatus includes a plurality of cartridges each including at least one of an image bearing member and a process member acting on the image bearing member, and a moving member to which the plurality of cartridges is detachably attached and which is movable between an inside and an outside of the image forming apparatus, wherein, of a pair of cartridges attached to the moving member and adjacent to each other, one cartridge has a recessed portion recessed from a frame member thereof and extending in an attachment direction of the cartridge, and the other cartridge has a raised portion protruding from the frame member thereof and extending in the attachment direction, wherein the raised portion provided on the other cartridge enters the recessed portion provided in the one cartridge when the pair of cartridges is attached to the moving member, and wherein positions of the raised portion and the recessed portion overlap each other as viewed in an axial direction of the image bearing member.

According to another aspect of the present invention, an image forming apparatus includes a plurality of cartridges each including at least one of an image bearing member and a process member acting on the image bearing member, and a moving member to which the plurality of cartridges is detachably attached and which is movable between an inside and an outside of the image forming apparatus, wherein, of the plurality of cartridges attached to the moving member, a central cartridge situated between other adjacent cartridges has a recessed portion recessed from a frame member thereof and extending in an attachment direction of the cartridge, and a raised portion protruding from the frame member thereof and extending in the attachment direction, wherein a raised portion provided on one of the adjacent cartridges enters the recessed portion provided in the central cartridge, and the raised portion provided on the central cartridge enters a recessed portion provided in the other adjacent cartridge when the plurality of cartridges is attached to the moving member, and wherein positions of the corresponding raised portions and recessed portions overlap each other when the raised portions and recessed portions provided on and in the plurality of cartridges are viewed in an axial direction of the image bearing member.

According to yet another aspect of the present invention, a cartridge that is detachably attachable to an apparatus main body of an image forming apparatus includes at least one of an image bearing member and a process member acting on the image bearing member, a frame member supporting the image bearing member or the process member, a recessed portion recessed from the frame member and extending in an attachment direction of the cartridge, and a raised portion protruding from the frame member and extending in the attachment direction, wherein the cartridge is attached to a moving member movable between an outside and an inside of the image forming apparatus together with other cartridges, the cartridge constituting a central cartridge arranged between other cartridges adjacent thereto, wherein, when each cartridge is attached to the moving member, a raised portion provided on one of the adjacent cartridges enters the recessed portion provided in the central cartridge, and the raised portion provided on the central cartridge enters a recessed portion provided in the other of the adjacent cartridges, and wherein, when the raised portions and recessed portions provided on and in the cartridges are viewed in an axial direction of the image bearing member, positions of the corresponding raised portions and recessed portions overlap each other.

Further features of the present invention will become apparent from the following detailed description of exemplary embodiments with reference to the attached drawings.

DESCRIPTION OF THE EMBODIMENTS

In the following, the first exemplary embodiment will be described with reference to FIGS. 1 through 8.

The image forming apparatus according to the following exemplary embodiment is, for example, a full color image forming apparatus to which four process cartridges, each including an image bearing member and a developing device, are attached.

However, the number of process cartridges attached to the image forming apparatus is not restricted to four. The number is to be set as appropriate as needed.

The image forming apparatus according to the exemplary embodiment described below is, for example, a printer. However, this should not be construed restrictively. The present exemplary embodiment is also applicable to other image forming apparatus such as a copying machine and a facsimile apparatus or a multifunction apparatus in which the functions of the above-mentioned apparatuses are combined.

Figure 2:
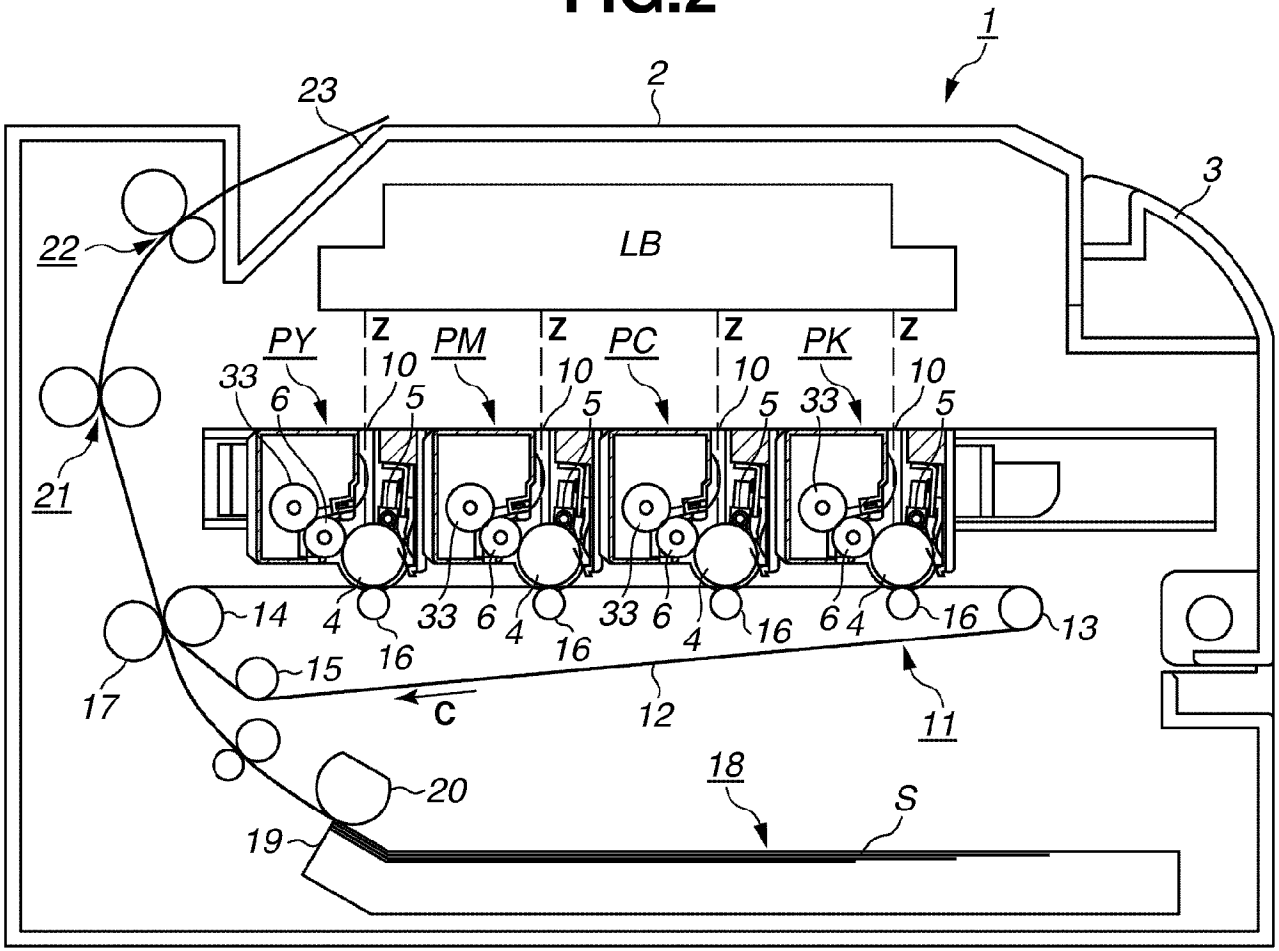
FIG. 2 is a schematic sectional view of the electrophotographic image forming apparatus according to the first exemplary embodiment.

First, FIG. 2 is a schematic sectional view of an image forming apparatus according to the present exemplary embodiment.

An image forming apparatus (electrophotographic image forming apparatus) 1 is a four full-color laser printer employing the electrophotographic process and configured to perform color image formation on a recording medium S. The image forming apparatus 1 adopts a process cartridge system, in which process cartridges P (hereinafter referred to as the cartridges) are detachably attached to an apparatus main body 2 and in which a color image is formed on the recording medium S. Here, the apparatus main body 2 is the main body portion of the image forming apparatus 1 and constitutes the portion obtained by removing the cartridges P from the image forming apparatus 1. The cartridges P have photosensitive drums 4 and process units acting thereon, and are integrally detachably attachable to the apparatus main body 2, constituting the image forming unit of the image forming apparatus 1.

Here, regarding the image forming apparatus 1, its side where an apparatus opening/closing door 3*i* s provided will be referred to as the front side (front surface), and the side opposite thereto will be referred to as the rear side (rear surface). When the image forming apparatus 1 is viewed from the front side, the right-hand side will be referred to as the driving side, and the left-hand side will be referred to as the driven side. In FIG. 2, the upper portion will be referred to as the upper surface, and the lower portion will be referred to as the lower surface.

In the apparatus main body 2, there are horizontally arranged four cartridges: a first cartridge PY, a second cartridge PM, a third cartridge PC, and a fourth cartridge PK (PY, PM, PC, and PK).

The first through fourth cartridges P (PY, PM, PC, and PK) have similar electrophotographic process mechanisms and differ from each other in toner color. A rotational drive force is transmitted to the first through fourth cartridges P (PY, PM, PC, and PK) from a drive output unit (not illustrated) of the apparatus main body 2.

Further, bias voltages (charging voltage, developing voltage, etc.) are supplied to the first through fourth cartridges P (PY, PM, PC, and PK) from the apparatus main body 2 (the voltages supplied being not illustrated).

Figure 3:
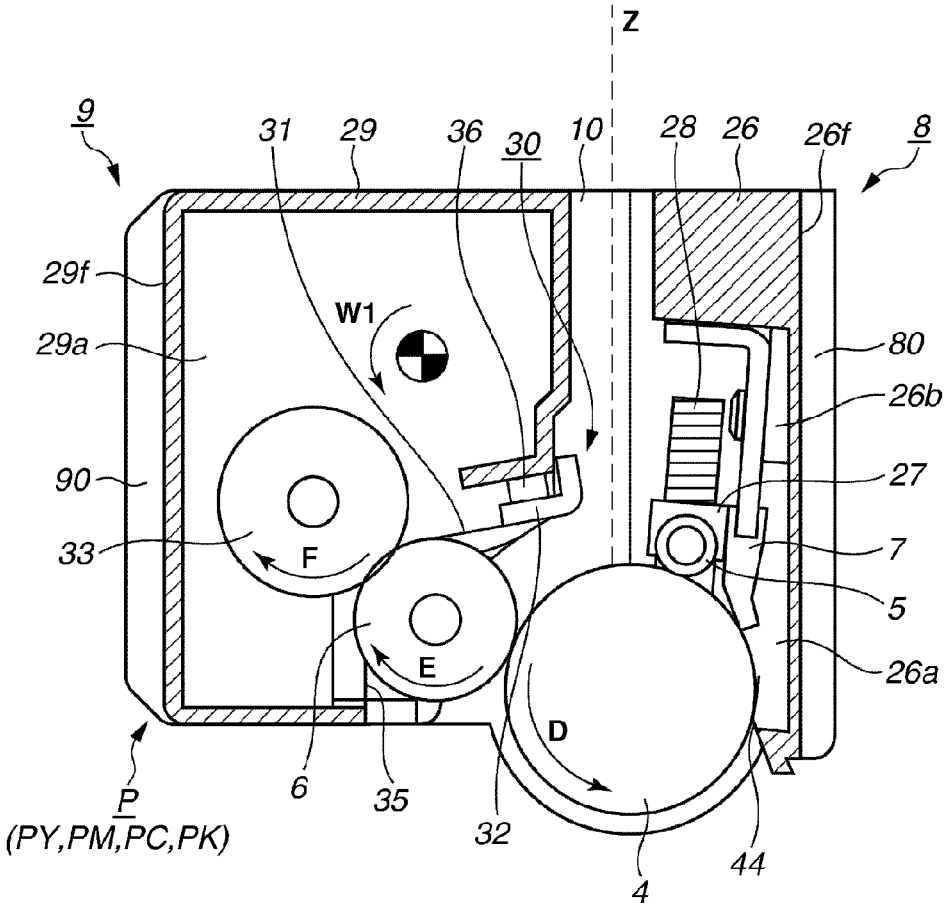
FIG. 3 is a sectional view of a cartridge according to the first exemplary embodiment.

As illustrated in FIG. 3, each of the first through fourth cartridges P (PY, PM, PC, and PK) has a photosensitive drum 4 as an image bearing member, and a charging unit as a process unit acting on the photosensitive drum 4. Further, the cartridge P has a cleaning device 8. The cleaning device 8 is a device having a cleaning blade 7 (described below) as a process unit (cleaning unit) acting on the photosensitive drum 4.

Further, each of the first through fourth cartridges P (PY, PM, PC, and PK) has a developing device 9 equipped with a developing unit configured to develop an electrostatic latent image on the photosensitive drum 4. The developing device 9 has a developing roller 6 (developer bearing member) as a process unit acting on the photosensitive drum 4.

The cleaning device 8 and the developing device 9 are connected with each other. Further, there are employed a charging roller 5 as a charging unit, a cleaning blade 7 as a cleaning unit, and a developing roller 6 as a developer bearing member serving as a developing unit. The configuration of the cartridge will be described in more detail below.

The first cartridge PY stores yellow (Y) toner in a developing frame member 29, and forms a yellow toner image on the surface of the photosensitive drum 4.

The second cartridge PM stores magenta (M) toner in the developing frame member 29, and forms a magenta toner image on the surface of the photosensitive drum 4.

The third cartridge PC stores cyan (C) toner in the developing frame member 29, and forms a cyan toner image on the surface of the photosensitive drum 4.

The fourth cartridge PK stores black (K) toner in the developing frame member 29, and forms a black toner image on the surface of the photosensitive drum 4.

In the following description of the cartridges PY, PM, PC, and PK, the affixes Y, M, C, and K indicating the colors of the toners they contain may be omitted, with the cartridges P being described collectively.

As illustrated in FIG. 2, a laser scanner unit LB as an exposure device is provided above the first through fourth cartridges P (PY, PM, PC, and PK). This laser scanner unit LB outputs laser light Z corresponding to image information. The laser light Z is transmitted through an exposure window portion 10 of the cartridge P to perform scanning on the surface of the photosensitive drum 4.

An intermediate transfer belt unit 11 as a transfer member is provided below the first through fourth cartridges P (PY, PM, PC, and PK). This intermediate transfer belt unit 11 has a driving roller 13, a turn roller 14, and a tension roller 15, and a flexible transfer belt 12 is stretched between them.

The lower surfaces of the photosensitive drums 4 of the first through fourth cartridges P (PY, PM, PC, and PK) are held in contact with the upper surface of the transfer belt 12. The contact portions constitute primary transfer portions. Inside the transfer belt 12, there are provided primary transfer rollers 16 opposite the photosensitive drums 4.

A secondary transfer belt 17 is held in contact with the turn roller 14 through the intermediation of the transfer belt 12.

A feeding unit 18 is provided below the intermediate transfer belt 11. This feeding unit 18 has a sheet feeding tray 19 accommodating the recording mediums S stacked together, and a sheet feeding roller 20.

In the left upper portion of the apparatus main body 2 as illustrated in FIG. 2, there are provided a fixing unit 21 and a discharge unit 22. The upper surface of the apparatus main body 2 constitutes a discharge tray 23.

Toner images are fixed to the recording medium S by a fixing device provided in the fixing unit 21, and then the recording medium is discharged onto the discharge tray 23.

The image forming apparatus performs the operation of forming a full color image as follows.

As illustrated in FIG. 2, the photosensitive drums 4 of the first through fourth cartridges P (PY, PM, PC, and PK) are rotated at a predetermined speed (counterclockwise as seen in FIG. 2, i.e., as indicated by the arrow D in FIG. 3).

The transfer belt 12 is also rotated forwards (in the direction indicated by the arrow in FIG. 2) with respect to the rotation of the photosensitive drums 4 at a speed corresponding to the speed of the photosensitive drums 4.

The laser scanner unit LB is also driven. In each cartridge, the charging roller 5 uniformly charges the surface of the photosensitive drum to a predetermined polarity and potential in synchronism with the driving of the laser scanner unit LB. The laser scanner unit LB performs scanning exposure on the surfaces of the photosensitive drums 4 with the laser light z corresponding to the image signals of the different colors.

As a result, electrostatic latent images corresponding to the image signals of the corresponding colors are formed on the surfaces of the photosensitive drums 4. The electrostatic latent images formed are developed by the developing rollers 6 rotated at a predetermined speed (clockwise in FIG. 2 or in the direction of the arrow E in FIG. 3).

Through the above-described electrophotographic image forming process operation, a yellow toner image corresponding to the yellow component of the full color image is formed on the photosensitive drum 4 of the first cartridge PY. Then, the toner image is primarily transferred onto the transfer belt 12.

Similarly, a magenta toner image corresponding to the magenta component of the full color image is formed on the photosensitive drum 4 of the second cartridge PM. Then, the toner image is primarily transferred to be superimposed on the yellow toner image already transferred onto the transfer belt 12.

Similarly, a cyan toner image corresponding to the cyan component of the full color image is formed on the photosensitive drum 4 of the third cartridge PC. Then, the toner image is primarily transferred to be superimposed on the yellow and magenta toner images already transferred onto the transfer belt 12.

Similarly, a black toner image corresponding to the black component of the full color image is formed on the photosensitive drum 4 of the fourth cartridge PK. Then, the toner image is primarily transferred to be superimposed on the yellow, magenta, and cyan toner images already transferred onto the transfer belt 12.

In this way, full-color unfixed toner images of the four colors of yellow, magenta, cyan, and black are formed on the transfer belt 12.

On the other hand, the recording mediums S are fed separately one by one with predetermined control timing. Each recording medium S is introduced into a secondary transfer portion constituting the contact portion between the secondary transfer roller 17 and the transfer belt 12 with predetermined control timing.

As a result, in the process in which the recording medium S is conveyed to the secondary transfer portion, the superimposed four color toner images on the transfer belt 12 are successively and collectively transferred to the surface of the recording medium S.

Figure 4:
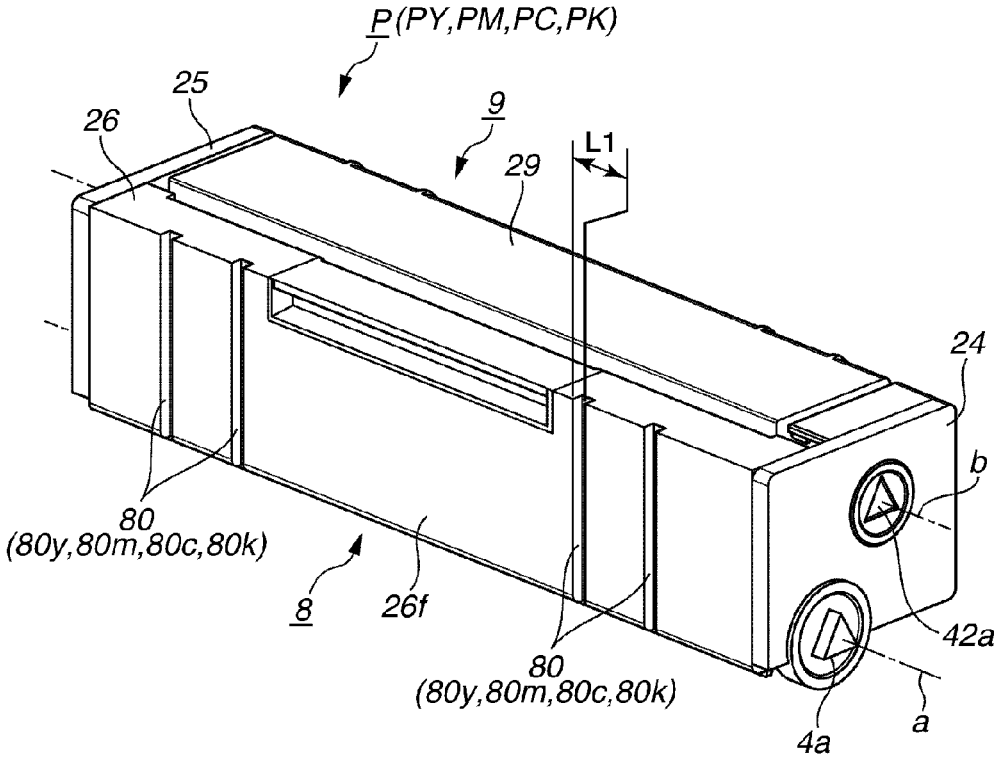
FIG. 4 is a perspective view of the cartridge according to the first exemplary embodiment.

As illustrated in FIG. 4, the cartridge P (PY, PM, PC, PK) is of a horizontally elongated configuration whose longitudinal direction is the direction of the rotation axis a (the axial direction) of the photosensitive drum 4. The cartridge P includes a cleaning device 8, a developing device 9, a driving side cover member 24, and a driven side cover member 25.

As illustrated in FIG. 3, the cleaning device 8 is composed of the photosensitive drum 4, the charging roller 5, the cleaning blade 7, and the cleaning frame member (first frame member) 26 supporting these.

As illustrated in FIG. 4, the photosensitive drum 4 is rotatably supported by the driving side cover member 24 and the driven side cover member 25. The photosensitive drum is rotated (in the direction of the arrow D in FIG. 3) by a drive force of a motor (not illustrated) of the apparatus main body 2 transmitted via a drum drive coupling 4*a*.

As illustrated in FIG. 3, the charging roller 5 is rotatably supported at both end portions thereof by charging roller bearings 27 of the cleaning frame member 26, and is driven to rotate while being in contact with the surface of the photosensitive drum 4 upon receiving a charging bias. At this time, to uniformly charge the surface, both end portions of the charging roller 5 are pressed against the surface of the photosensitive drum 4 by a charging roller pressure spring 28.

The cleaning blade 7 is fixed to a support surface 26*b* of the cleaning frame member 26, and the distal end thereof is provided so as to abut on the photosensitive drum 4 in a direction against the rotational direction (the direction indicated by the arrow D in FIG. 3) of the photosensitive drum 4. At the time of image formation, transfer residual toner remaining on the photosensitive drum 4 is scraped off to perform cleaning on the surface of the photosensitive drum 4. At this time, to completely scrape off the transfer residual toner, the distal end of the cleaning blade 7 is held in contact with the surface of the photosensitive drum 4 with a predetermined pressure.

The transfer residual toner scraped off from the surface of the photosensitive drum 4 by the cleaning blade 7 is accommodated in a waste toner accommodation portion 26*a* of the cleaning frame body 26. For this purpose, a waste toner recovery sheet member 44 for preventing leakage of waste toner from the gap between the photosensitive drum and the cleaning blade 7 is fixed to the cleaning frame member 26 so as to extend in the longitudinal direction of the photosensitive drum 4.

The developing device 9 has a developing roller 6 as a developer bearing member for bearing developer, and is of a horizontally elongated configuration whose longitudinal direction is the axial direction of the developing roller 6. As illustrated in FIG. 3, the developing device 9 is a unit (developing unit) formed by the developing roller 6, a developing blade 31, a developer supply roller 33, a flexible sheet member 35, and a developing frame member (second frame member) 29 supporting these.

The developing frame member 29 has a toner accommodation portion 29*a* accommodating toner, and has an opening for discharging toner to the exterior from the toner accommodation portion 29*a*.

The developing roller 6 and the developer supply roller 33 are arranged in the vicinity of the opening of the developing frame member 29, and both axial end portions of the developing roller 6 and of the developer supply roller 33 are rotatably supported by bearing members (not illustrated) attached to both side surfaces of the developing frame member 29.

The developing blade unit 30 is a unit composed of the developing blade 31, and a support sheet metal 32 supporting the developing blade 31, and the support sheet metal 32 is fixed to the developing frame member 29 by a screw. The developing blade 31 is an elastic sheet metal having a thickness of approximately 0.1 mm, and the distal end in the lateral direction of the developing blade 31 abuts on the developing roller 6 in a counter direction with respect to the rotational direction of the developing roller 6 (direction indicated by the arrow E in FIG. 3). That is, the distal end of the developing blade 31 is arranged so as to be directed upwards in the rotational direction of the developing roller 6.

The flexible sheet member 35 is arranged so as to abut on a longitudinal side surface on the side opposite the developing blade 31 at the opening of the developing frame member 29, and prevents toner leakage from the gap between the developing frame member 29 and the developing roller 6.

In the developing device 9, the developing roller 6 is constantly urged around a swinging axis b illustrated in FIG. 4 so as to be held in contact with the photosensitive drum 4 (in the direction indicated by the arrow W1 of FIG. 3) by a pressure spring (not illustrated), with the developing roller 6 being held in contact with the photosensitive drum 4.

At the time of image formation, a developer supply roller 33 and the developing roller 6 are rotated through driving to be rubbed against each other, whereby the toner discharged from the toner accommodation portion 29*a* is carried by the developing roller 6. The developing blade 31 regulates the thickness of the toner layer formed on the peripheral surface of the developing roller 6, and imparts to the toner an electric charge due to frictional charging between itself and the developing roller 6 through the contact pressure.

Then, at the contact portion between the developing roller 6 and the photosensitive drum 4, the toner with the electric charge on the developing roller 6 adheres to the electrostatic latent image on the photosensitive drum 4, thereby developing the electrostatic latent image.

Next, the operation of attaching and detaching the cartridges P (PY, PM, PC, and PK) to and from the apparatus main body 2 will be described.

Figure 6:
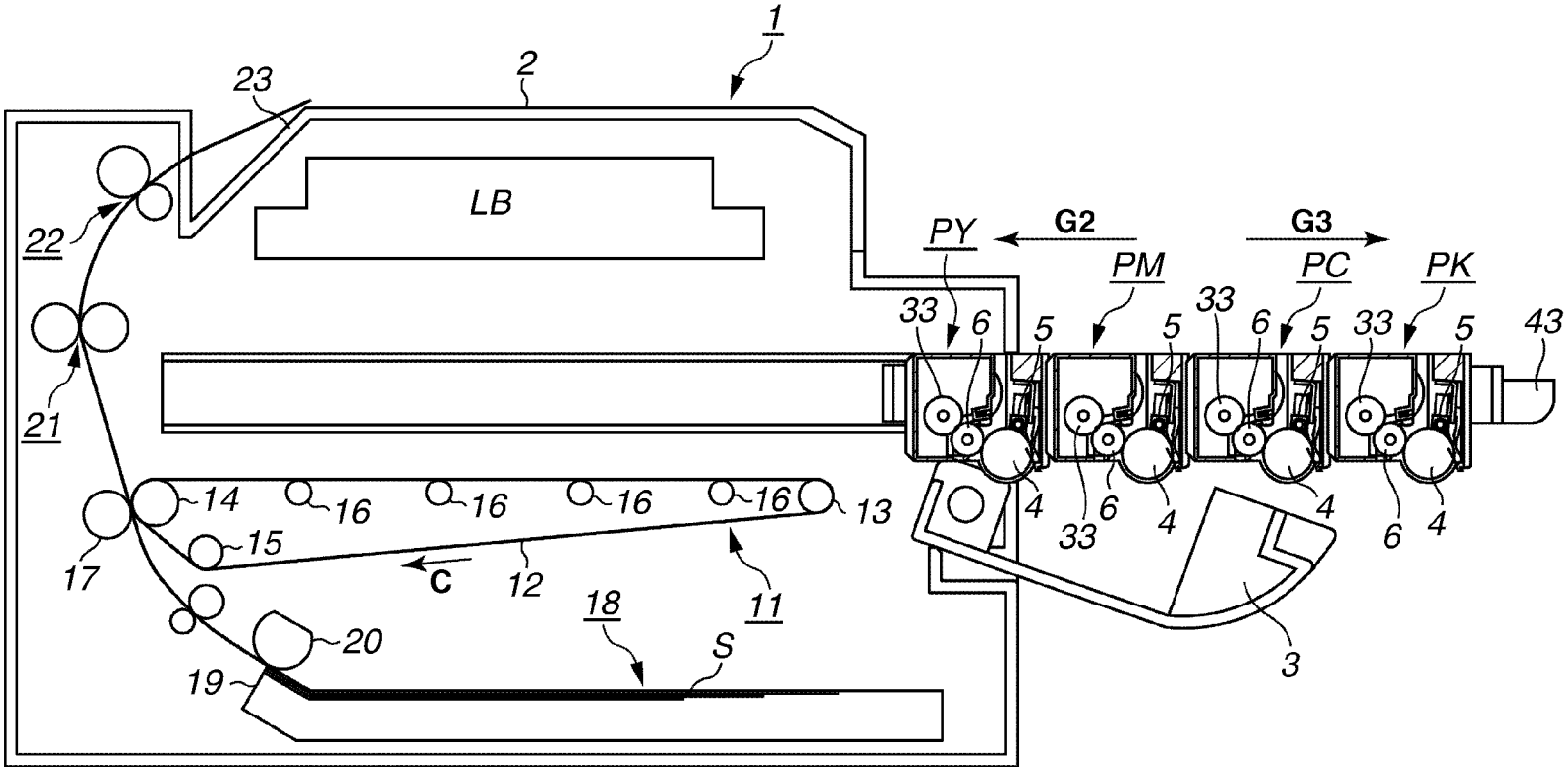
FIG. 6 is a schematic sectional view illustrating a cartridge attachment/detachment method according to the first exemplary embodiment.

FIG. 6 is a schematic sectional view illustrating the state in which a cartridge tray 43 has been drawn out of the apparatus main body 2 to allow attachment/detachment of the cartridges P.

Figure 7:
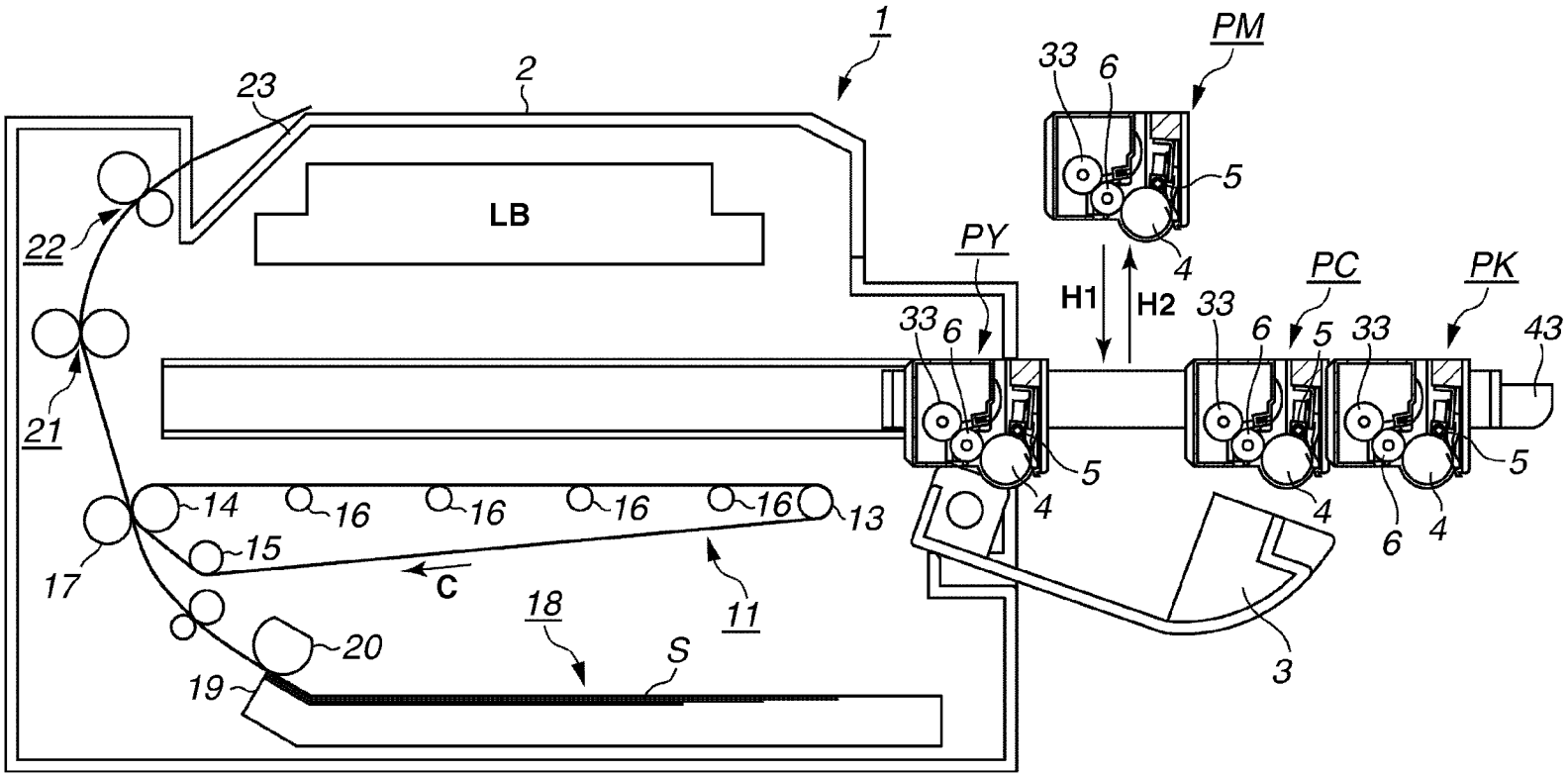
FIG. 7 is a schematic sectional view illustrating the cartridge attachment/detachment method according to the first exemplary embodiment.

FIG. 7 is a schematic sectional view illustrating the operation of attaching and detaching the cartridges P to and from the cartridge tray 43.

As illustrated in FIG. 6, inside the apparatus main body 2, there is provided the cartridge tray 43 constituting the attachment portion to which the cartridges P are to be attached.

The cartridge tray 43 is a moving member formed so as to be capable of straight movement (pushing-in/drawing-out) in directions G2 and G3, which are substantially horizontal with respect to the apparatus main body 2. The cartridge tray 43 can assume an attachment position (FIG. 2) inside the apparatus main body 2 and a drawn-out position (FIG. 7) where the cartridges have been drawn out from within the apparatus main body 2. The cartridge tray 43 moves with respect to the apparatus main body 2 with a plurality of cartridges P (PY, PM, PC, and PK) placed thereon, thereby enabling the cartridges P to be attached and detached to and from the apparatus main body 2. In the following, this operation will be described in detail.

First, the operation of attaching the cartridges P (PY, PM, PC, and PK) to the apparatus main body 2 will be described. By opening an apparatus opening/closing door 3 and moving the cartridge tray 43 in the direction of the arrow G3 in FIG. 6, the cartridge tray 43 moves to the drawn-out position. In this state, the cartridges P are attached to the cartridge tray 43 from the direction of the arrow H1 and retained thereon. Here, the direction of the arrow H1 is the vertical direction. It is a direction crossing the axial direction of the photosensitive drums 4 provided in the cartridges P (the direction perpendicular to the plane of FIG. 7) (in the present exemplary embodiment, a direction substantially orthogonal to the axial direction).

The cartridge tray 43 retaining the cartridges P is moved in the direction of the arrow G in FIG. 6, and the cartridge tray 43 moves to the attachment position within the apparatus main body 2. Then, by closing the apparatus opening/closing door 3, the operation of attaching the cartridges P to the apparatus main body 2 is completed.

On the other hand, the operation of extracting the cartridges P from the apparatus main body 2 will be described. As in the case of the operation of attaching the cartridges P to the apparatus main body described above, the cartridge tray 43 is moved to the drawn-out position (FIG. 7). In this state, the cartridge P is extracted in the direction of the arrow H2 in FIG. 7, and the operation of extracting the cartridges P from the apparatus main body 2 is completed.

Through the above operation, the cartridges P can be attached and detached to and from the apparatus main body 2.

Figure 1:
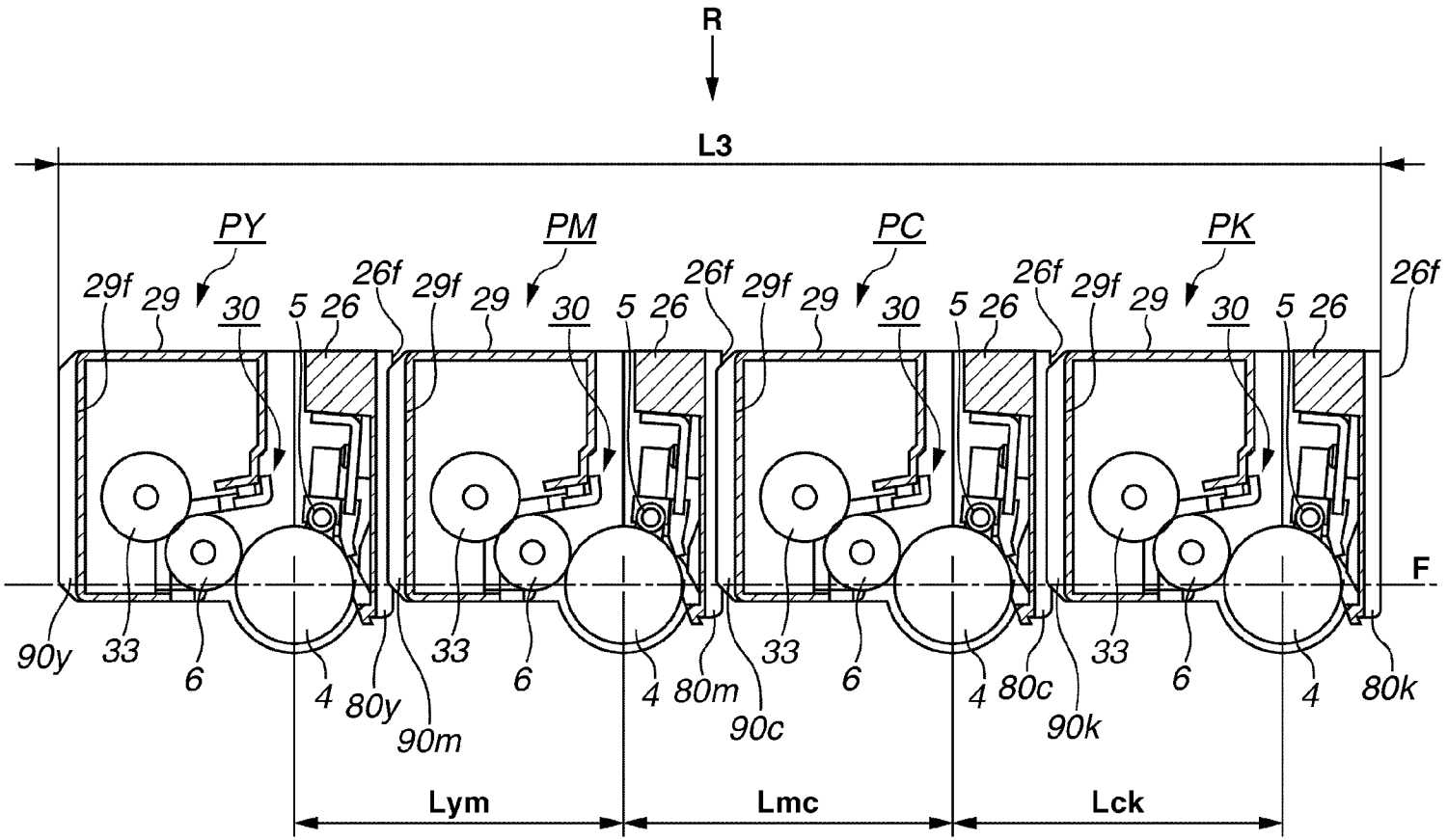
FIG. 1 is a sectional view illustrating the arrangement relationship between cartridges attached to an electrophotographic image forming apparatus according to a first exemplary embodiment.
Figure 5:
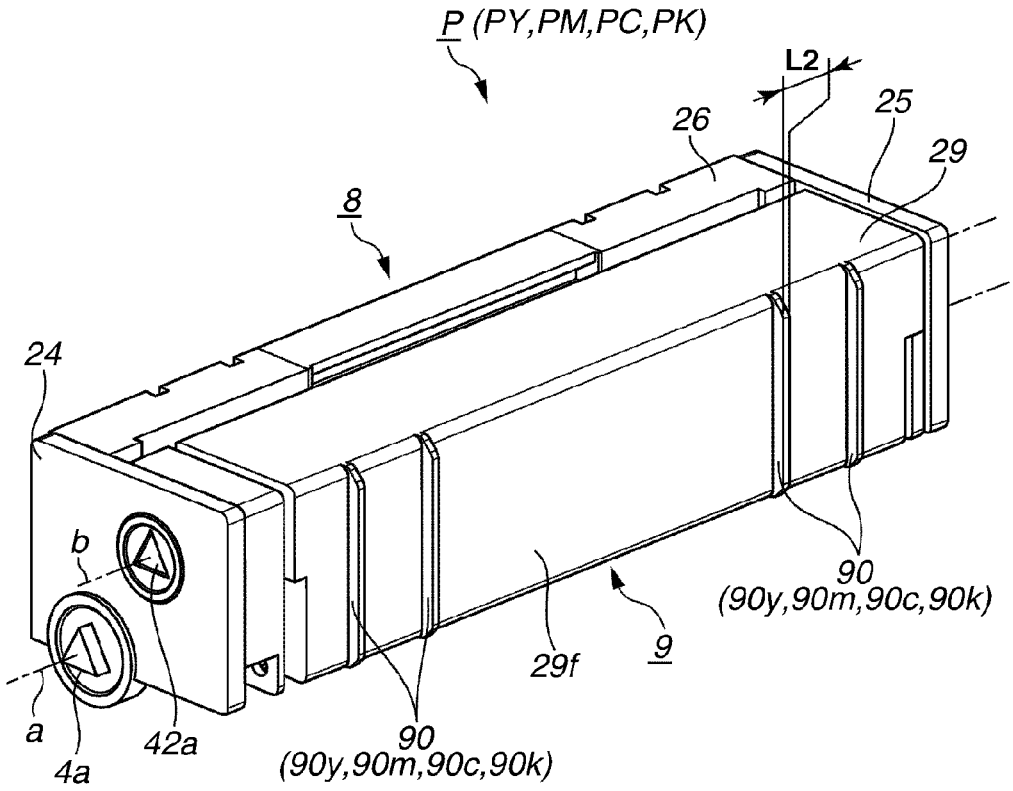
FIG. 5 is a perspective view of the cartridge according to the first exemplary embodiment.

FIG. 1 illustrates the arrangement of the cartridges P (PY, PM, PC, and PK) according to the first exemplary embodiment as attached to the cartridge tray 43 of the apparatus main body 2. FIGS. 4 and 5 are perspective views of the cartridge according to the first exemplary embodiment.

In FIG. 1, the direction of the line connecting the centers of the photosensitive drums 4 of the adjacent cartridges P will be referred to as the horizontal direction F. That is, in FIG. 1, the horizontal direction F extends from the left to the right.

As illustrated in FIG. 1, the cleaning frame member 26 constituting a part of the frame member of each cartridge P (cartridge frame member) and forming the cleaning device 8 has a surface 26*f* (see FIG. 4) opposite the adjacent cartridge P. The surface 26*f* is provided with recessed shapes (first recessed portions) 80 (80*y*, 80*m*, 80*c*, and 80*k*) recessed from the surface 26*f* and extending substantially in the attachment/detachment directions of the cartridge P (the directions indicated by the arrows H1 and H2 in FIG. 7). The recessed shapes 80 are groove portions extending in a direction crossing the axial direction of the photosensitive drum (substantially in an orthogonal direction in the present exemplary embodiment).

Further, a developing frame member 29 constituting apart of the frame member of each cartridge P (cartridge frame member) and forming the developing device 9 has a surface 29*f* (see FIG. 5) opposite the adjacent cartridge P. The surface 29*f* is provided with raised shapes (first raised portions) 90 (90*y*, 90*m*, 90*c*, and 90*k*) protruding from the surface 29*f* and extending substantially in the attachment/detachment directions for the cartridge P (the directions indicated by the arrows H1 and H2 in FIG. 7). The raised shapes 90 are ribs extending in a direction crossing the axial direction of the photosensitive drum (a direction substantially orthogonal thereto in the present exemplary embodiment).

The recessed shapes 80 and the raised shapes 90 are arranged such that the raised shapes 90 enter the recessed shapes 80. That is, assuming that the width of the recessed shapes 80 provided at four positions in the longitudinal direction is L1 (see FIG. 4), and that the width of the raised shapes 90 provided at four positions in the longitudinal direction is L2 (see FIG. 5), their relationship is set as follows: L1>L2.

When the cartridge P is attached to the cartridge tray 43, the recessed shapes 80 and the raised shapes 90 are arranged so as to be overlap each other in position as seen in the direction in which the rotation axis a of the photosensitive drum (see FIGS. 4 and 5) extends (the axial direction). The positional relationship between the recessed shapes 80 and the raised shapes 90 will be described in more detail below.

As illustrated in FIG. 1, the cartridges P are arranged horizontally from the left in the order: the first cartridge PY, the second cartridge PM, the third cartridge PC, and the fourth cartridge PK. In particular, in the present exemplary embodiment, they are arranged such that the axial directions of the respective photosensitive drums 4 of the cartridges P are parallel to each other.

Here, the raised shape 90*m* provided on the developing frame member 29 of the second cartridge PM enters the recessed shape 80*y* provided in the cleaning frame member 26 of the first cartridge PY in the horizontal direction F (see FIG. 1). In this direction, the cartridge PY and the cartridge PM are brought close to each other so as to reduce the distance between the respective photosensitive drums 4 provided in the cartridge PY and the cartridge PM adjacent to each other.

Further, the raised shape 90*c* provided on the developing frame member 29 of the third cartridge PC enters the recessed shape 80*m* provided in the cleaning frame member 26 of the second cartridge PM in the horizontal direction F. Further, the raised shape 90*k* provided on the developing frame member 29 of the fourth cartridge PK enters the recessed shape 80*c* provided in the cleaning frame member 26 of the third cartridge PC in the cartridge horizontal direction F.

Figure 8:
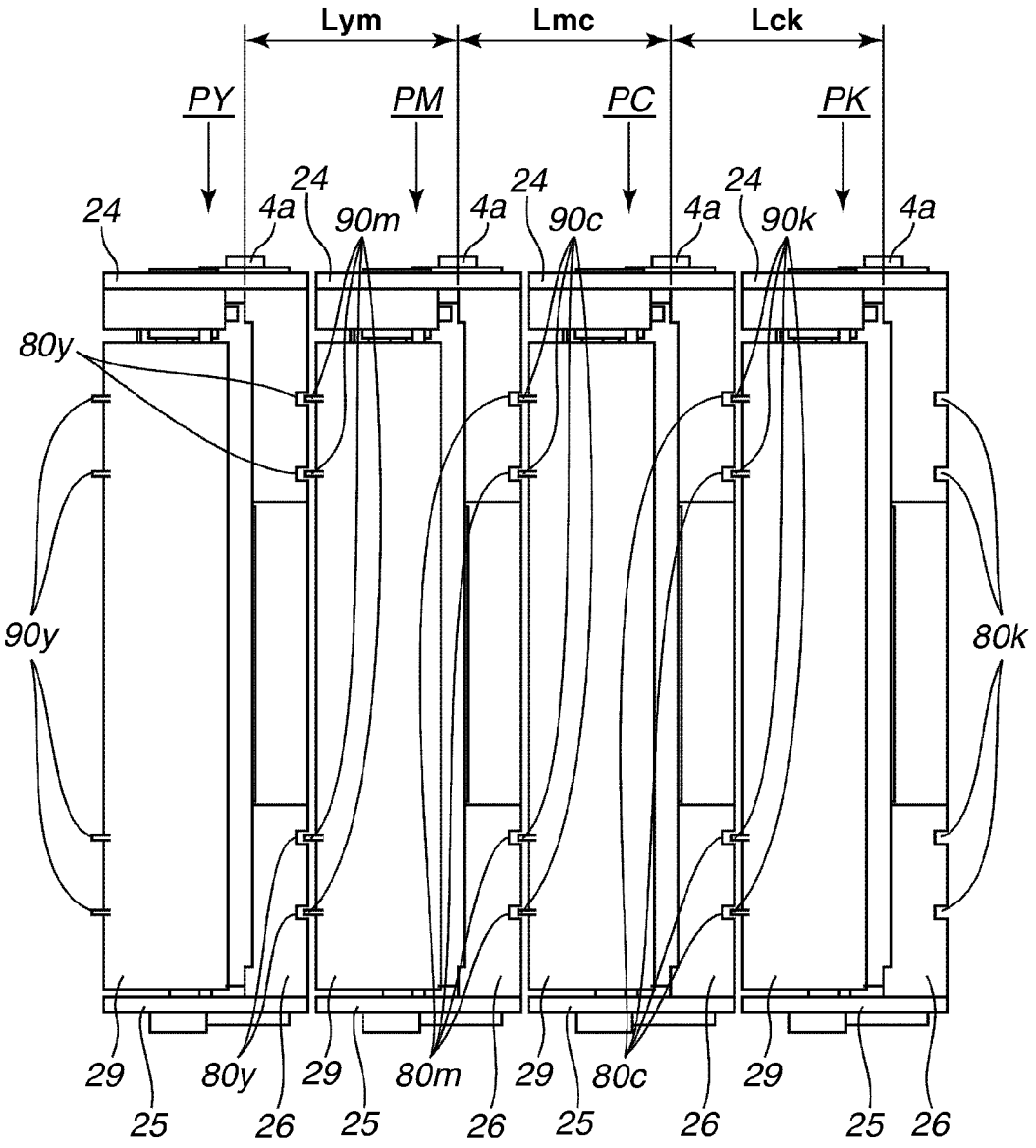
FIG. 8 is a top view illustrating the arrangement relationship between the cartridges attached to the electrophotographic image forming apparatus according to the first exemplary embodiment.

FIG. 8 is a diagram (top view) illustrating the construction of FIG. 1 as seen from the upstream side in the attachment direction of the cartridges P (from the direction indicated by the arrow R in FIG. 1). As illustrated in FIG. 8, in the state in which the cartridges P (PY, PM, PC, and PK) have been attached to the apparatus main body 2, the raised shape 90 provided on one of a pair of adjacent process cartridges enters the recessed shape 80 provided in the other of the pair.

For example, four recessed shapes 80 are arranged in the cleaning frame member 26 of the cartridge PM so as to be side by side in the axial direction of the photosensitive drum 4. On the developing frame member 29 of the cartridge PC situated adjacent to the cartridge PM, four raised shapes 90*c* are provided so as to be in correspondence with the recessed shapes 80*m*.

Here, as seen from the direction in which the cartridge PM and the cartridge PC are attached to the cartridge tray 43, the recessed shapes 80*m* and the raised shapes 90*c* are situated so as not to interfere with each other. When the cartridge PM and the cartridge PC are attached to the cartridge tray 43, the four raised shapes 90*c* of the cartridge PC enter the corresponding ones of the four recessed shapes 80*m* provided in the cartridge PM.

Also between the cartridge PY and the cartridge PM, and between the cartridge PC and the cartridge PK, there are provided recessed shapes 80 and raised shapes 90 similar to the recessed shapes 80*m* and the raised shapes 90*c* provided between the cartridge PM and the cartridge PC.

For example, of the three cartridges PY, PM, and PC, the raised shapes 90*m* provided on the central cartridge PM enter the recessed shapes 80*y* provided in the cartridge PY of the two adjacent cartridges. Further, the raised shapes 90*c* provided on the cartridge PC of the two adjacent cartridges enter the recessed shapes 80*m* provided in the central cartridge PM.

Here, as illustrated in FIG. 1, when seen in the axial direction of the photosensitive drums 4 (the direction perpendicular to the plane of FIG. 1), the recessed shapes 80 and the raised shapes 90 opposite each other of the cartridges adjacent to each other overlap each other (situated so as to overlap).

That is, the raised shapes 90 enter the recessed shapes 80 in the horizontal direction F to bring the adjacent cartridges P close to each other. As a result, it is possible to reduce the inter-axis distances Lym, Lmc, and Lck between the respective photosensitive drums 4 of the cartridges PY, PM, PC, and PK. As a result, the total width L3 of the cartridges PY, PM, PC, and PK when arranged within the apparatus main body is diminished, whereby it is possible to reduce the size of the apparatus main body 2.

Here, as stated above, the frame member of each cartridge P (cartridge frame member) is formed by the developing frame member 29 and the cleaning frame member 26. Of these, the cleaning frame member 26 is provided with the recessed shapes 80, and the developing frame member 29 is provided with the raised shapes 90, whereby it is possible to achieve an improvement in terms of sectional secondary moment in the portion where the recessed shapes 80 and the raised shapes 90 are added, thereby making it possible to enhance the rigidity of the cleaning frame member 26 and the developing frame member 29.

As a result, it is possible to attain compatibility between an enhancement in the rigidity of the cleaning device 8 and of the developing device 9 and a reduction in the size of the apparatus main body 2.

By achieving an enhancement in the rigidity of the cleaning frame member 26 and the developing frame member 29, it is possible to achieve the following effect. That is, when the user firmly grasps the surface 26*f* of the cleaning frame member 26 (see FIG. 4) and the surface 29*f* of the developing frame member 29 (see FIG. 5), it is possible to suppress deformation of each frame member. In other words, it is possible to suppress an abrupt change in the inner volume of the waste toner accommodation portion 26*a* provided inside the cleaning frame member 26 (see FIG. 3) and in the inner volume of the toner accommodation portion 29*a* provided inside the developing frame member 29 (see FIG. 3). As a result, it is possible to suppress abrupt fluctuation in the air pressure (inner pressure) in the cartridge P. The waste toner accommodation portion 26*a* is a space surrounded by the cleaning blade 7, the waste toner recovery sheet member 44, and the photosensitive drum 4. The toner accommodation portion 29*a* is a space surrounded by the developing frame member 29, the developing blade unit 30, the developing roller 6, and the flexible sheet member 35.

By suppressing a change in the inner pressure of the cartridge P, it is possible to suppress scattering of the waste toner inside the cleaning frame member 26 from the contact portion between the photosensitive drum 4 and the waste toner recovery sheet member 44. Further, it is possible to suppress scattering to the exterior of the toner inside the developing frame member 29 from the contact portion between the developing roller 6 and the flexible sheet member 35.

Further, by enhancing the rigidity of the cleaning frame member 26 and of the developing frame member 29, it is possible to maintain with high precision the positional relationship among the photosensitive drum 4, the cleaning blade 7, the developing roller 6, the developing blade 31, etc.

Further, according to the present exemplary embodiment, the cleaning frame member 26 is provided with the recessed shapes 80, and the developing frame member 29 is provided with the raised shapes 90. However, it is also possible to attain the same effect by providing the cleaning frame member 26 with raised shapes, and providing the developing frame member 29 with recessed shapes.

Further, although according to the present exemplary embodiment, four pairs of recessed shapes and raised shapes are provided, the number is not restricted thereto but can be set differently as needed.

Further, according to the present exemplary embodiment, the cartridge P is provided with a plurality of recessed shapes 80 and raised shapes 90, wherein the cleaning frame member 26 is solely provided with the recessed shapes 80, whereas the developing frame member 29 is solely provided with raised shapes 90. However, it is also possible for a single frame member to be provided with both recessed shapes 80 and raised shapes 90 in a mixed fashion. In this case, it is possible to attain the same effect so long as the recessed shapes 80 and the raised shapes 90 are formed in pairs opposite to each other.

That is, in the present exemplary embodiment, of a pair of cartridges adjacent to each other, one cartridge is provided with recessed shapes (first recessed portions), and the other cartridge is provided with raised shapes (first raised portions). However, it is also possible to further provide the other cartridge with recessed shapes (second recessed portions). In this connection, one cartridge may be provided not only the recessed shapes (first recessed portions) but also raised shapes (second raised portions), wherein the raised shapes (second raised portions) enter the recessed shapes (second recessed portions) provided in the other cartridge.

Further, although in the above examples the plurality of raised shapes 90 and the plurality of recessed shapes 80 are uniform in configuration, it is also possible for them to be of different configurations.

Further, according to the present exemplary embodiment, the cleaning device 8 having the photosensitive drum 4, the cleaning member, and the charging member is formed by the cleaning frame member 26, and the developing device 9 having the developing member is formed by the developing frame member 29. However, it is also possible to attain the same effect by supporting the photosensitive drum 4, the cleaning member, the charging member, and the developing member by a single frame member, with the surface of the frame member and the surface of the adjacent cartridge opposite the same being respectively provided with raised shapes and recessed shapes.

As described above, of a pair of cartridges P adjacent to each other, the frame member of one cartridge is provided with recessed shapes 80 extending in the cartridge attachment/detachment direction, and the frame member of the other cartridge is provided with raised shapes 90 extending in the cartridge attachment/detachment direction. When seen in the axial direction of the photosensitive drum 4, the recessed shapes 80 and the raised shapes 90 are situated such that the raised shapes 90 overlap the recessed shapes 80.

Further, when the cartridges P (PY, PM, PC< and PK) are attached, the raised shapes 90 can enter the recessed shapes 80. It is possible to arrange two adjacent cartridges still closer to each other so that the distance between the photosensitive drums may be shortened.

As a result, it is possible to enhance the rigidity of the cartridges, and to achieve a reduction in size of the image forming apparatus.

Figure 9:
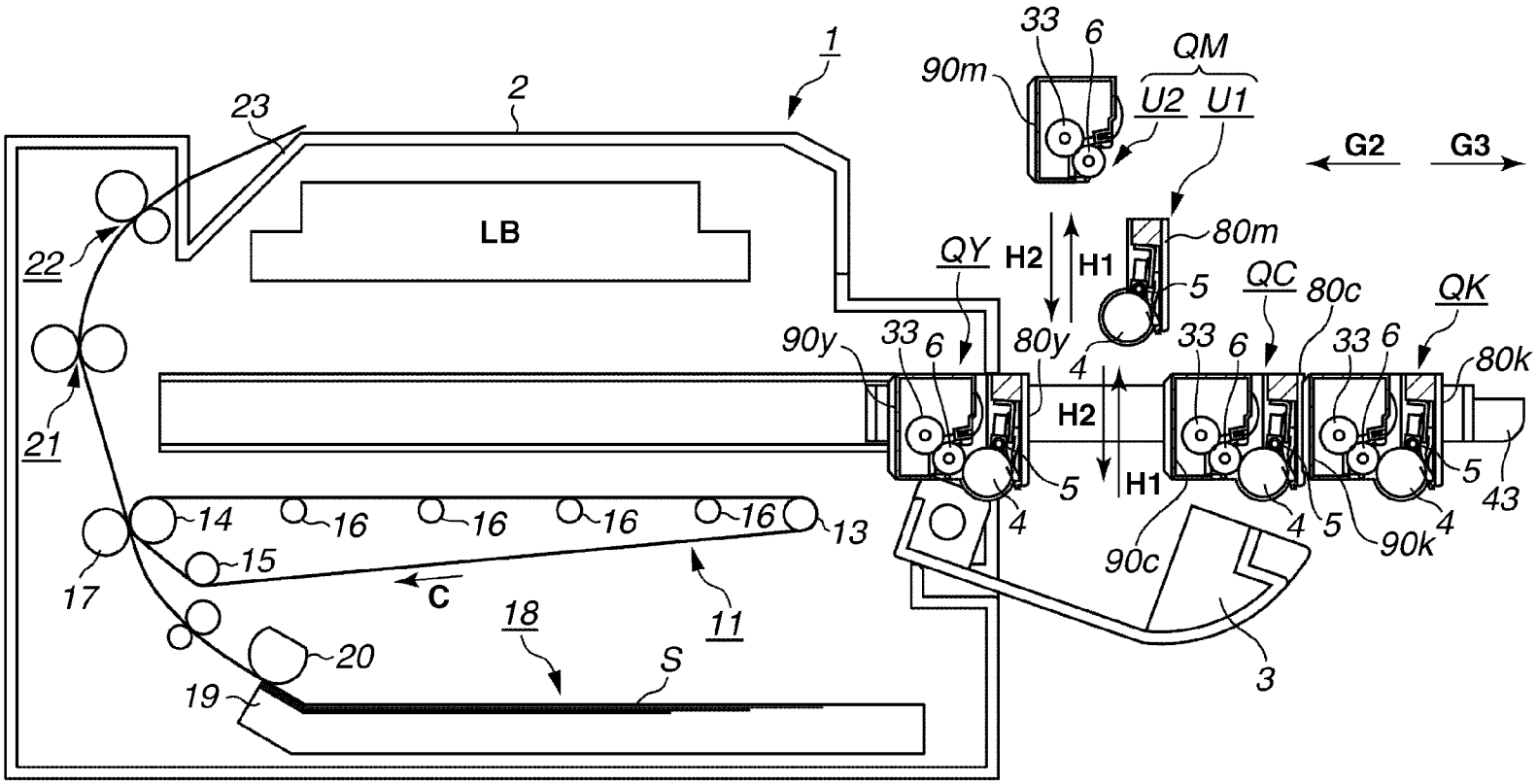
FIG. 9 is a schematic sectional view illustrating a cartridge attachment/detachment method according to a second exemplary embodiment.

FIG. 9 is a schematic sectional view illustrating a cartridge attachment/detachment method according to a second exemplary embodiment. The present exemplary embodiment differs from the first exemplary embodiment (FIG. 7) in that each image forming units Q (QY, QM, QC, and QK) of different colors which are equipped with photosensitive drums 4 and process members, is constituted by a cleaning unit U1 and a developing unit U2, which are separable. That is, in the present exemplary embodiment, the cleaning unit U1 and the developing unit U2 are individually formed as cartridges, and are individually attached and detached as a drum cartridge and a developing cartridge.

First, by way of example, the operation of attaching the image forming unit QM (U1 and U2) of the image forming units Q (QY, QM, QC, and QK) to the apparatus main body 2 will be described.

As illustrated in FIG. 9, by opening the apparatus opening/closing door and moving the cartridge tray 43 in the direction of the arrow G3 in FIG. 9, the cartridge tray 43 is moved to the drawn-out position. In this state, the cleaning unit U1 as the drum cartridge is attached to the cartridge tray 43 from the direction of the arrow H1 in FIG. 9, and is retained thereon. Further, the developing unit U2 as the developing cartridge is also attached to the cartridge tray 43 from the direction of the arrow H1 in FIG. 9, and is retained thereon. The cartridge tray 43 retaining the cleaning unit U1 and the developing unit U2 are moved in the direction of the arrow G2 in FIG. 9, and the cartridge tray 43 is moved to the attachment position inside the apparatus main body 2. Then, by closing the apparatus opening/closing door 3, the operation of attaching the image forming unit QM to the apparatus main body 2 is completed.

On the other hand, the operation of extracting the image forming unit QM from the apparatus main body 2 will be described. As in the case of the operation of attaching the image forming unit QM to the apparatus main body 2 described above, the cartridge tray 43 is moved to the drawn-out position. In this state, the developing unit U2 is extracted in the direction of the arrow H2 in FIG. 9, and, subsequently, the cleaning unit U1 is extracted in the direction of the arrow H2 in FIG. 9, whereby the operation of extracting the image forming unit QM from the apparatus main body 2 is completed.

Through the above operation, the image forming unit QM can be attached and detached to and from the apparatus main body 2. The image forming units QY, QC, and QK are of a similar construction, and involve a similar operation.

As in the case of the recessed shapes 80 (see FIG. 4) described in connection with the first exemplary embodiment, the cleaning unit U1 according to the present exemplary embodiment has a plurality of recessed shapes extending in the attachment/detachment directions H1 and H2.

Further, as in the case of the raised shapes (see FIG. 5) described in connection with the first exemplary embodiment, the cleaning unit U2 according to the present exemplary embodiment has a plurality of raised shapes extending in the attachment/detachment directions H1 and H2. As in the above-described exemplary embodiment, in the present exemplary embodiment also, recessed shapes and raised shapes are formed so as to extend parallel to the attachment/detachment direction of the photosensitive member unit U1 and the developing unit U2.

Here, of a pair of adjacent image forming units of a plurality of (four) image forming units Q, the raised shapes provided on the developing unit U2 of one image forming unit enter the recessed shapes provided in the photosensitive member unit U1 of the other image forming unit.

In other respects, the present exemplary embodiment is similar to the first exemplary embodiment.

As described above, of the pair of adjacent cleaning unit U1 and developing unit U2, the frame member of one unit has the recessed shapes 80 extending parallel to the attachment/detachment direction thereof. The frame member of the other unit has the raised shapes 90 extending parallel to the attachment/detachment direction thereof.

The recessed shapes 80 and the raised shapes 90 are arranged so as not to interfere with each other when the cleaning unit U1 and the developing unit U2 move in the attachment/detachment direction. As a result, when the cleaning unit U1 and the developing unit U2 are attached to the cartridge tray 43, the raised shapes enter the recessed shapes.

When the cleaning unit U1 and the developing unit U2 in this state are seen in the axial direction of the photosensitive drums 4, the recessed shapes 80 and the raised shapes 90 overlap each other.

As a result, due to the recessed shapes and the raised shapes, it is possible to enhance the rigidity of the cleaning unit U1 (drum cartridge) and of the developing unit U2 (developing cartridge), and to achieve a reduction in size of the image forming apparatus.

In conclusion, the advantages of the image forming apparatus and of the process cartridge according to the present exemplary embodiment can be summarized as follows. That is, it is possible to enhance the rigidity of the cartridges. Further, in the image forming apparatus equipped with a moving member configured to move with a plurality of cartridges placed thereon, it is possible to achieve a reduction in size of the moving member and of the image forming apparatus main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-116937 filed May 22, 2012, which is hereby incorporated by reference herein in its entirety.

What is claimed is:

1. An image forming apparatus comprising:

a plurality of cartridges each including at least one of an image bearing member and a process member acting on the image bearing member; and a moving member to which the plurality of cartridges is detachably attached and which is movable between an inside and an outside of the image forming apparatus, wherein, of a pair of cartridges attached to the moving member and adjacent to each other, one cartridge has a recessed portion recessed from a frame member thereof and extending in an attachment direction of the cartridge, and the other cartridge has a raised portion protruding from the frame member thereof and extending in the attachment direction, wherein the raised portion provided on the other cartridge enters the recessed portion provided in the one cartridge when the pair of cartridges is attached to the moving member, and wherein positions of the raised portion and the recessed portion overlap each other as viewed in an axial direction of the image bearing member.

2. The image forming apparatus according to claim 1, wherein the image forming apparatus includes a color image forming apparatus equipped with a plurality of the image bearing members, and wherein the pair of cartridges includes cartridges for forming images of respective different colors.

3. The image forming apparatus according to claim 1, wherein the pair of cartridges is attached to the moving member by being moved in a direction crossing the axial direction of the image bearing member.

4. The image forming apparatus according to claim 1, wherein, of the pair of cartridges, the one cartridge has a plurality of the recessed portions, and the other cartridge has a plurality of the raised portions, and wherein, when the raised portions and the recessed portions are viewed in the axial direction of the image bearing members, the corresponding raised portions and recessed portions overlap each other in position.

5. The image forming apparatus according to claim 1, wherein each of the pair of cartridges is a process cartridge including the image bearing member and a developer bearing member serving as the process member.

6. The image forming apparatus according to claim 5, wherein the process cartridge includes, as the frame member, a first frame member supporting the image bearing member, and a second frame member supporting the developer bearing member, and wherein the recessed portion is formed in the first frame member of the one cartridge, and the raised portion is formed on the second frame member of the other cartridge, or the recessed portion is formed in the second frame member of the one cartridge has, and the raised portion is formed on the first frame member of the other cartridge.

7. The image forming apparatus according to claim 1, wherein the pair of cartridges includes a cartridge including the image bearing member and a cartridge including a developer bearing member serving as the process member.

8. The image forming apparatus according to claim 1, wherein, of the pair of cartridges, the one cartridge further has a raised portion protruding from the frame member thereof and extending in the attachment direction thereof, wherein the other cartridge further has a recessed portion recessed from the frame member thereof and extending in the attachment direction thereof, wherein the raised portion provided on the one cartridge enters the recessed portion provided in the other cartridge when the pair of cartridges is attached to the moving member, and wherein, when each raised portion and each recessed portion provided on the pair of cartridges are viewed in the axial direction of the image bearing member, positions of the corresponding raised portion and recessed portion overlap each other.

9. An image forming apparatus comprising:

a plurality of cartridges each including at least one of an image bearing member and a process member acting on the image bearing member; and a moving member to which the plurality of cartridges is detachably attached and which is movable between an inside and an outside of the image forming apparatus, wherein, of the plurality of cartridges attached to the moving member, a central cartridge situated between other adjacent cartridges has a recessed portion recessed from a frame member thereof and extending in an attachment direction of the cartridge, and a raised portion protruding from the frame member thereof and extending in the attachment direction, wherein a raised portion provided on one of the adjacent cartridges enters the recessed portion provided in the central cartridge, and the raised portion provided on the central cartridge enters a recessed portion provided in the other adjacent cartridge when the plurality of cartridges is attached to the moving member, and wherein positions of the corresponding raised portions and recessed portions overlap each other when the raised portions and recessed portions provided on and in the plurality of cartridges are viewed in an axial direction of the image bearing member.

10. The image forming apparatus according to claim 9, wherein the image forming apparatus includes a color image forming apparatus equipped with a plurality of the image bearing members, and wherein the plurality of cartridges includes cartridges for forming images of respective different colors.

11. The image forming apparatus according to claim 9, wherein the plurality of cartridges is attached to the moving member by being moved in a direction crossing the axial direction of the image bearing member.

12. The image forming apparatus according to claim 9, wherein, of the plurality of cartridges, the central cartridge has a plurality of the recessed portions and a plurality of the raised portions, the one of the adjacent cartridges has a plurality of the raised portions, and the other adjacent cartridge has a plurality of the recessed portions, and wherein, when the raised portions and the recessed portions are viewed in the axial direction of the image bearing members, the corresponding raised portions and recessed portions overlap each other in position.

13. The image forming apparatus according to claim 9, wherein each of the plurality of cartridges is a process cartridge including the image bearing member and a developer bearing member serving as the process member.

14. The image forming apparatus according to claim 13, wherein the process cartridge includes, as the frame member, a first frame member supporting the image bearing member, and a second frame member supporting the developer bearing member, and wherein the central cartridge has the recessed portion in one of the first frame member and the second frame member, and has the raised portion on the other of the first frame member and the second frame member.

15. A cartridge that is detachably attachable to an apparatus main body of an image forming apparatus, the cartridge comprising:

at least one of an image bearing member and a process member acting on the image bearing member;

a frame member supporting the image bearing member or the process member;

a recessed portion recessed from the frame member and extending in an attachment direction of the cartridge; and a raised portion protruding from the frame member and extending in the attachment direction, wherein the cartridge is attached to a moving member movable between an outside and an inside of the image forming apparatus together with other cartridges, the cartridge constituting a central cartridge arranged between other cartridges adjacent thereto, wherein, when each cartridge is attached to the moving member, a raised portion provided on one of the adjacent cartridges enters the recessed portion provided in the central cartridge, and the raised portion provided on the central cartridge enters a recessed portion provided in the other of the adjacent cartridges, and wherein, when the raised portions and recessed portions provided on and in the cartridges are viewed in an axial direction of the image bearing member, positions of the corresponding raised portions and recessed portions overlap each other.

16. The cartridge according to claim 15, wherein the cartridge is a process cartridge including:

an image bearing member; and a developer bearing member serving as the process member.

* * * * *